US005159320A

United States Patent [19]

Matsuo et al.

[11] Patent Number: 5,159,320

[45] Date of Patent: Oct. 27, 1992

[54] GRAPHIC DATA PROCESSING SYSTEM FOR EXTENDING FONT DATA INTO COLOR DATA WHICH IS INPUT INTO AN IMAGE MEMORY

[75] Inventors: Shigeru Matsuo, Hitachi; Koyo Katsura, Hitachiohta; Jun Sato, Musashino; Masahiko Kikuchi, Hitachi, all of Japan

[73] Assignee: Hitachi, Ltd., Tokyo, Japan

[21] Appl. No.: 565,910

[22] Filed: Aug. 10, 1990

Related U.S. Application Data

[63] Continuation of Ser. No. 325,387, Mar. 20, 1989, abandoned, which is a continuation of Ser. No. 72,094, Jul. 10, 1987, abandoned.

[30] Foreign Application Priority Data

Jul. 14, 1986 [JP] Japan ..... 61-165393

[51] Int. Cl.[5] ..... G06G 5/02

[52] U.S. Cl. ..... 340/701; 340/703; 340/750; 340/799

[58] Field of Search ..... 340/701, 703, 728, 799, 340/747, 748, 750, 793; 358/11, 12, 21 R, 27, 28

[56] References Cited

U.S. PATENT DOCUMENTS

| | | | |
|---|---|---|---|
| 3,573,789 | 4/1971 | Sharp et al. | 340/728 |
| 3,893,100 | 7/1975 | Stein | 340/728 |
| 3,911,418 | 10/1975 | Takeda | 340/703 |
| 4,555,802 | 11/1985 | Fedak et al. | 340/728 |
| 4,591,842 | 5/1986 | Clarke, Jr. et al. | 340/703 |
| 4,632,579 | 12/1986 | Takano et al. | 340/728 |
| 4,635,048 | 1/1987 | Nishi et al. | 340/703 |
| 4,639,721 | 1/1987 | Eto | 340/703 |

FOREIGN PATENT DOCUMENTS 0146961 7/1985 European Pat. Off. .

*Primary Examiner*—Alvin E. Oberley
*Assistant Examiner*—Richard Hjerpe
*Attorney, Agent, or Firm*—Antonelli, Terry, Stout & Kraus

[57] ABSTRACT

A graphic data processing system including an image memory for storing a character pattern as font data composed of binary information and for displaying graphic data of the character pattern, first and second color registers for holding color information corresponding respectively to the "0" and "1" signals of the font data stored in the image memory, data extending device for extending each bit of the font data, which are stored in the image memory, for one word into extended data having n bits where n bits represent one pixel, a multiplexer for multiplexing for each of the n bits color information, which is latched in the first and second color registers, wherein the multiplexing is performed independently at respectively corresponding bit units on the basis of the extended data from the data extending device and a device for masking and writing the color information of one word, multiplexed by the multiplexer, as graphic data at bit units in the image memory, whereby a plurality of pixels in one word are processed simultaneously in parallel.

9 Claims, 9 Drawing Sheets

$$Ai = Mi \cdot (Zi \boxtimes Wi) + \overline{Mi} \cdot Wi$$

LOGICAL ARITHMETIC DESIGNATED BY DRAWING MODE REGISTER

GRAPHIC DATA PROCESSING SYSTEM FOR EXTENDING FONT DATA INTO COLOR DATA WHICH IS INPUT INTO AN IMAGE MEMORY

This application is a continuation of application, now abandoned, Ser. No. 325,387, filed on Mar. 20, 1989, now abandoned, which is a continuation of Ser. No. 072,094 filed Jul. 10, 1987, now abandoned.

BACKGROUND OF THE INVENTION

The present invention relates to a graphic data processing system and, more particularly, to a graphic data processing system which is appropriate for increasing the processing rate.

A system of the prior art is constructed as follows, as is disclosed in European Patent Application, publication number 0146961 (Jul. 3, 1985): Pixel addresses composed of address information for designating addresses of an image memory and pixel position designating information for designating pixel positions in one word, which are designated by the addresses, are sequentially calculated. The one-word graphic data designated by the address information of the pixel addresses calculated are read out from the image memory. Then, with information decoded from the pixel position designating information of the pixel addresses for designating a plurality of bit positions corresponding to the designated pixel positions, only a predetermined bit expressing one pixel of the graphic data read out is subjected to a graphic logical operation. The result of this logical operation is written again in the image memory so that it may be displayed.

In the prior art described above, the one-word graphic data in the image memory are considered such that the processing performance may be equivalent to that for a monochromatic image irrespective of the bit number composing one pixel. In case the one-word graphic data in the image memory have information of plural pixels, no consideration is taken into the point that those plural pixels are processed simultaneously in parallel. When the plural pixels in one word are to be continuously processed, the graphic data in the same address of the image memory have to be accessed and processed a plurality of times, thus raising a problem that the processing rate is decreased.

SUMMARY OF THE INVENTION

An object of the present invention is to provide a graphic data processing system which can draw an image at a processing rate as high as that of the case in which one word of an image memory has a single pixel, even in the case where the one word has a plurality of pixels.

The above-specified object can be achieved by a graphic data processing system comprising: an image memory for storing a character pattern as font data composed of monochromatic information and for displaying the graphic data of the character pattern; first and second color registers for holding color information corresponding respectively to the "0" and "1" signals of the font data stored in the image memory; data extending means for extending the m bit of the font data, which are stored in the image memory, for m pixels (of one word) into m × n bits on the basis of the bit number n composing one pixel; a multiplexer for multiplexing the color information, which is latched in the first and second color registers, independently at respectively corresponding bit units on the basis of the data extended by the data extending means; and means for masking the data of the one word, which is multiplexed by the multiplexer, at the bit units and written as the graphic data in the image memory.

The data extending means extends the data in the image memory into one word simultaneously, and the multiplexer multiplexes the color information independently at each bit on the basis of the extended data. As a result, the graphic data processing system according to the present invention processes the plural pixels in one word simultaneously in parallel.

Other objects and features of the present invention will become apparent from the following description to be made in connection with the embodiment.

DETAILED DESCRIPTION OF THE EMBODIMENT

The embodiment of the present invention will be described in the following with reference to the accompanying drawings.

Figure 2:
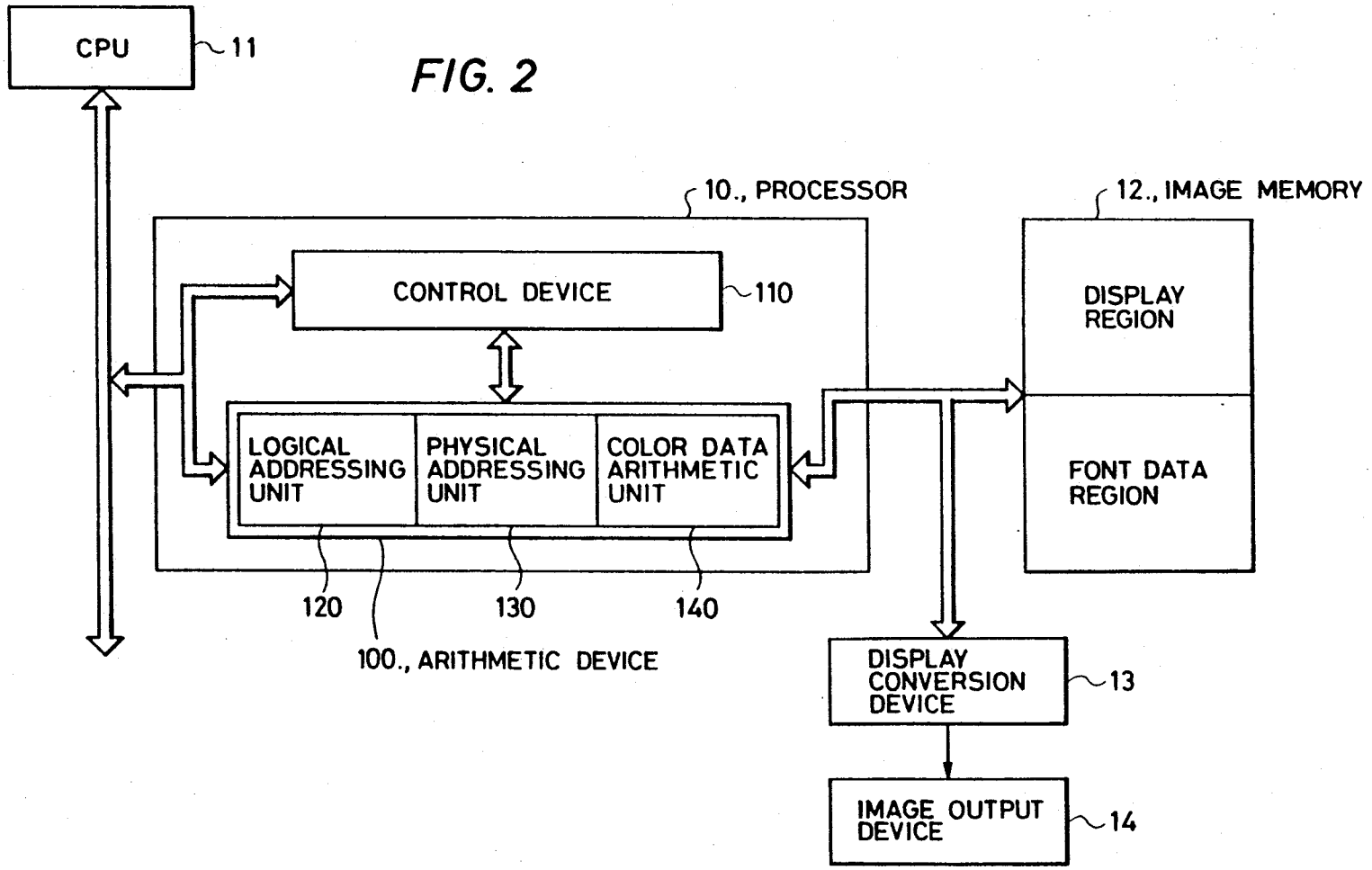
FIG. 2 is a block diagram showing the overall structure of the graphic data processing system according to the embodiment.

FIG. 2 is a block diagram showing a graphic data processing system according to the embodiment of the present invention. A processor 10, which may preferably be formed on a single semiconductor substrate, is connected on one hand with a central processing unit (i.e., CPU) 11, which may preferably be formed on single semiconductor substrate, and on the other hand with an image memory 12 formed of a font data region and a display region. This image memory 12 is connected through a display conversion device 13 with either an image output device 14 such as a cRT, a liquid crystal display or an EL display or an image output device 14 represented by a printer or the like.

The processor 10 is constructed of an arithmetic device 100 for reading, rewriting and writing the data of the image memory 12, and a control device 110 for controlling the arithmetic device 100 in a constant sequence. The arithmetic device 100 is further divided into a logical addressing unit 120, a physical addressing unit 130 and a color data arithmetic unit 140.

The data stored in the font region of the image memory 12 are arithmetically processed by the arithmetic device 100 of the processor 10. More specifically, a drawing point in a display frame is logically and arithmetically calculated in the logical addressing unit 120 in accordance with a drawing algorithm. The actual physical addressing of the image memory 12 is made in the physical addressing unit 130. The color data to be written in the image memory 12 are calculated in the color data arithmetic unit 140. The result calculated by the arithmetic device 100 is sent to the display region of the image memory 12 in accordance with the instruction of the central processing unit (CPU) 11. Moreover, the data of the image memory 12 are converted by the display conversion device 13 into display data, which are sent to the display device 14.

Figure 3:
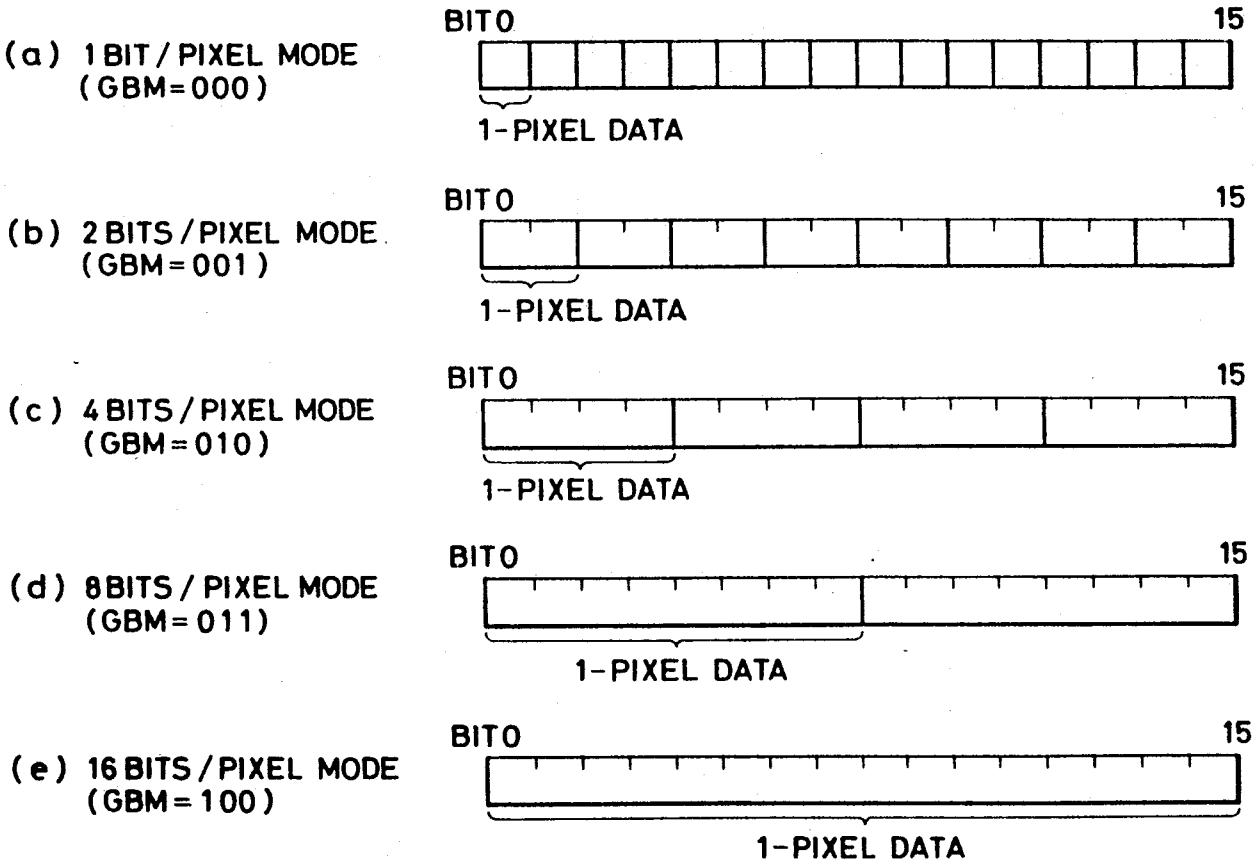
FIG. 3 presents the bit layouts of the image data used in the graphic data processing system according to the embodiment.
Figure 4:
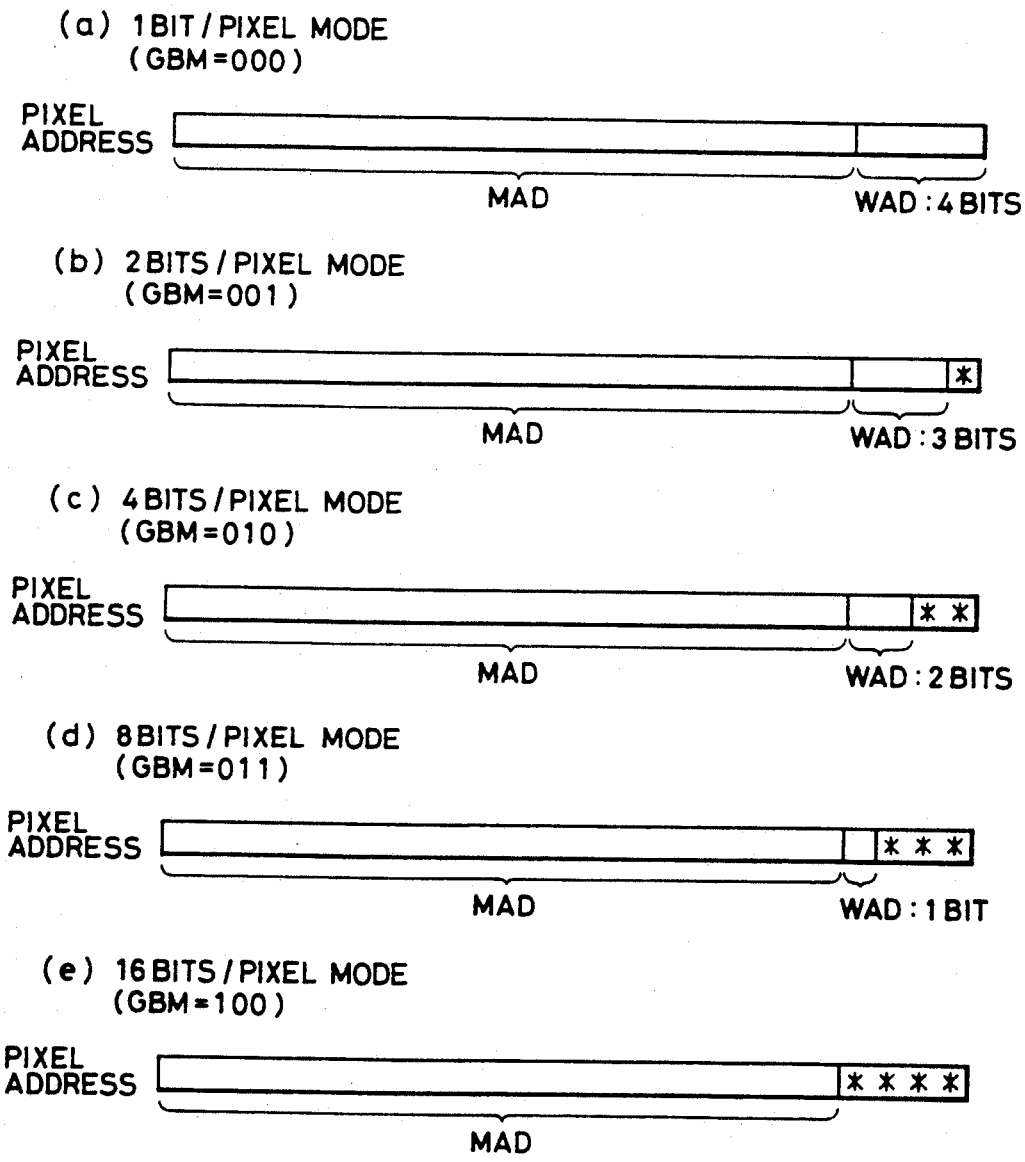
FIG. 4 presents the bit layouts of the pixel addresses used in the graphic data processing system according to the embodiment.

Next, the fundamental items concerning the graphic data processing system according to the present embodiment will be described with reference to FIGS. 3 to 5. Of these: FIG. 3 presents diagrams showing the bit structures of one word in individual pixel modes of the image memory 12; FIG. 4 presents diagrams showing pixel addresses corresponding to the pixel modes, respectively; and FIGS. 5A-5C are diagrams showing the spacial arrangement of the image memory 12.

First of all, five bit structures can be selected as the pixel modes, as shown at (a) to (e) in FIG. 3:

(a) One Bit / Pixel Mode:

This is the mode which is used in case one pixel is expressed with one bit, as in a monochrome image. Data of a series of sixteen pixels are stored in the one word of the image memory 12. Moreover, this mode corresponds to a GBM signal "000" indicating the bit number composing one pixel.

(b) Two Bits / Pixel Mode;

This mode expresses one pixel with two bits and is used to display four colors or tones at the maximum. Data of a series of eight pixels are stored in one word of the image memory 12. Moreover, the GBM signal is "001".

(c) Four Bits / Pixel Mode;

This mode expresses one pixel with four bits, and data of a series of four pixels are stored in one word of the image memory 12. Moreover, the GBM signal is "010".

(d) Eight Bits / Pixel Mode:

This mode expresses one pixel with eight bits, and data of two pixels are stored in one word of the image memory 12. Moreover, the GBM signal is "011".

(e) Sixteen Bits / Pixel Mode:

This mode expresses one pixel with sixteen bits, and one word of the pixel memory 12 corresponds to one-pixel data. Moreover, the GBM signal is "100".

Secondly, a pixel address is adopted. This pixel address is constructed, as shown in FIG. 4, of address information MAD for designating the address of the image memory 12, and pixel position designating information WAD for designating what the position is in one word designated with the address. The pixel position designating information WAD is prepared as a bit address, i.e., a part of a physical address in the less significant four bits of the pixel address and is calculated by the physical addressing unit 130. Moreover, the pixel position designating information WAD at the less significant four bits is used to designate the pixel position in one word in accordance with each bit / pixel mode. On the other hand, symbols "*" appearing in FIG. 4 indicate bits having no relation to the arithmetic.

Thirdly, the image data in one word at the address of the image memory 12 designated with the address information MAD in the pixel address are read out all at once from the image memory 12. Then, only a predetermined bit part of the image data is modified on the basis of the pixel position designating information in the pixel address, the GBM signal indicating the bit number composing one pixel, and the information indicating the number of pixels to be updated. The image data thus modified are written in the corresponding address of the image memory 12. Thus, a plurality of bits corresponding to one or plural pixels are processed simultaneously in parallel.

Figure 5C:
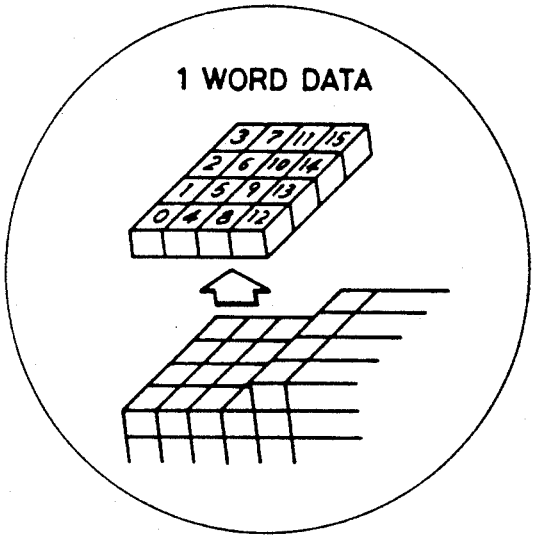
FIGS. 5A–5C is present various is a diagram for explaining the operations of the graphic data processing system according to the embodiment.
Figure 5A:
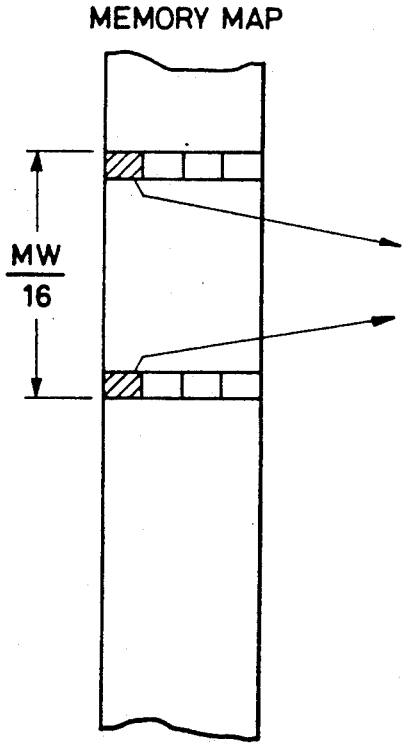
Figure 5B:
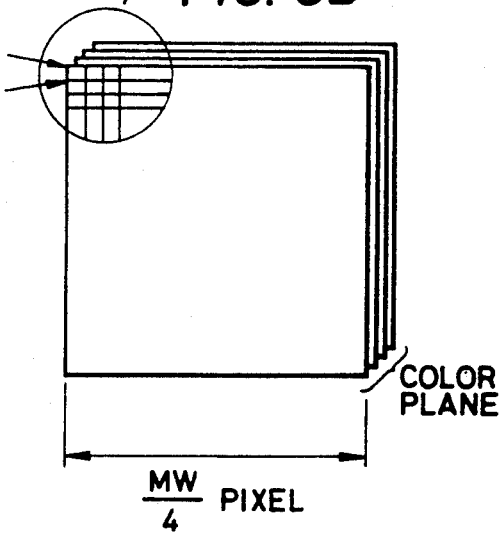

The spacial arrangement of the image memory 12 in case the pixel mode is the four bits / pixel mode is shown in FIG. 5. The address of the image memory 12 is assigned as a linear address, as shown in a memory map of FIG. 5A, and is displayed as a two-dimensional image, as shown in FIG. 5B. The Memory Width MW of the display frame indicates how many bits the horizontal width of the display frame is composed of. In the case of the four bits / pixel mode, therefore, a MW/4 pixel is displayed in the horizontal direction. Since one pixel is displayed with four bits, moreover, one-word data are displayed as data of a series of four pixels in the horizontal direction, as shown in FIG. 5C.

The number of the bits composing one pixel may be added or subtracted so as to shift the physical address one pixel in the horizontal direction, whereas the value of MW may be added or subtracted so as to move the same one pixel in the vertical direction. On the other hand, the bit number of one word may be added or subtracted so as to process the plural pixels of one word.

Considering the fundamental items thus far described, the major portions of the graphic data processing system according to the present embodiment will be described in the following.

Figure 1:
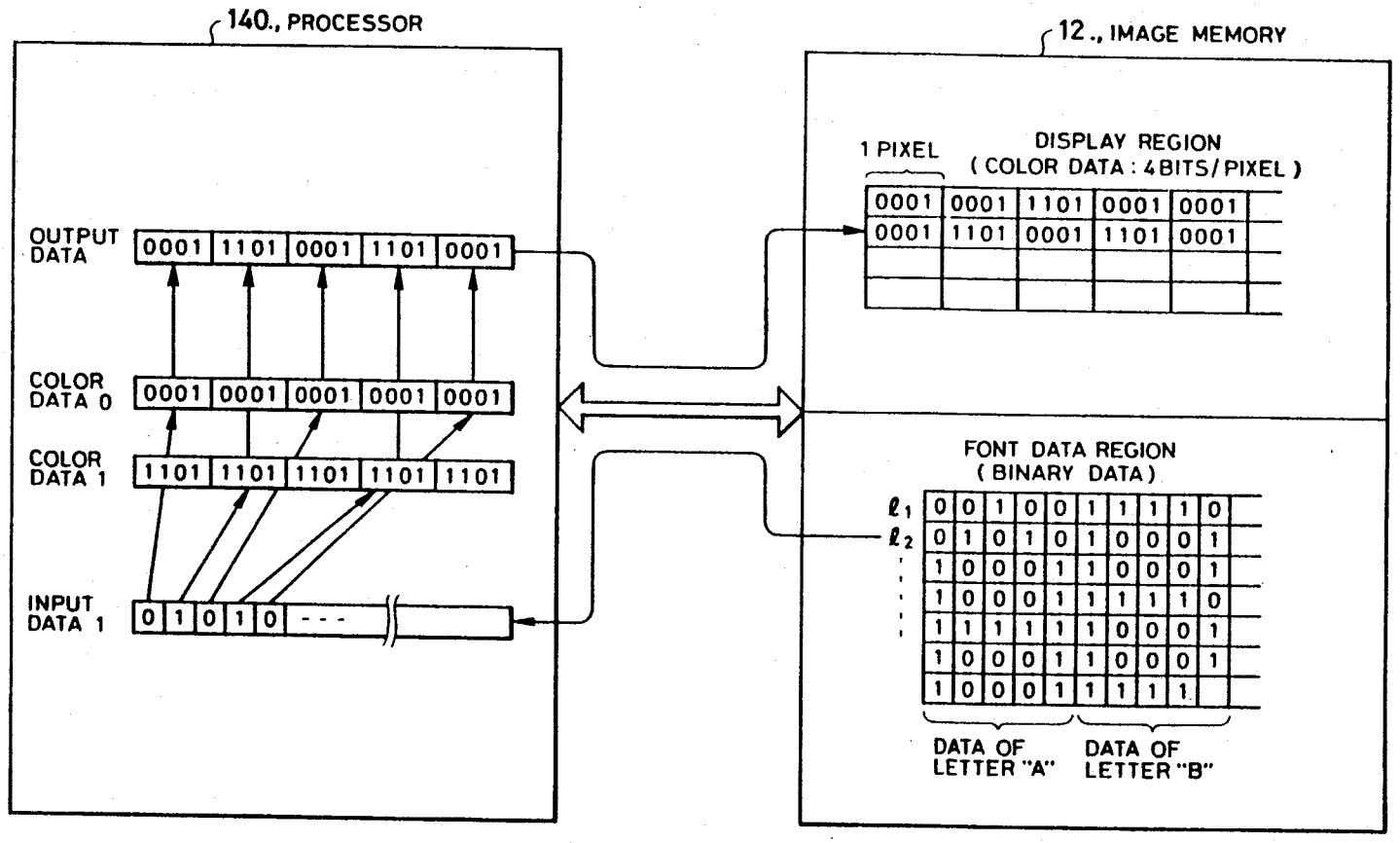
FIG. 1 is a block diagram showing the major portion of the graphic data processing system according to one embodiment of the present invention.
Figure 6:
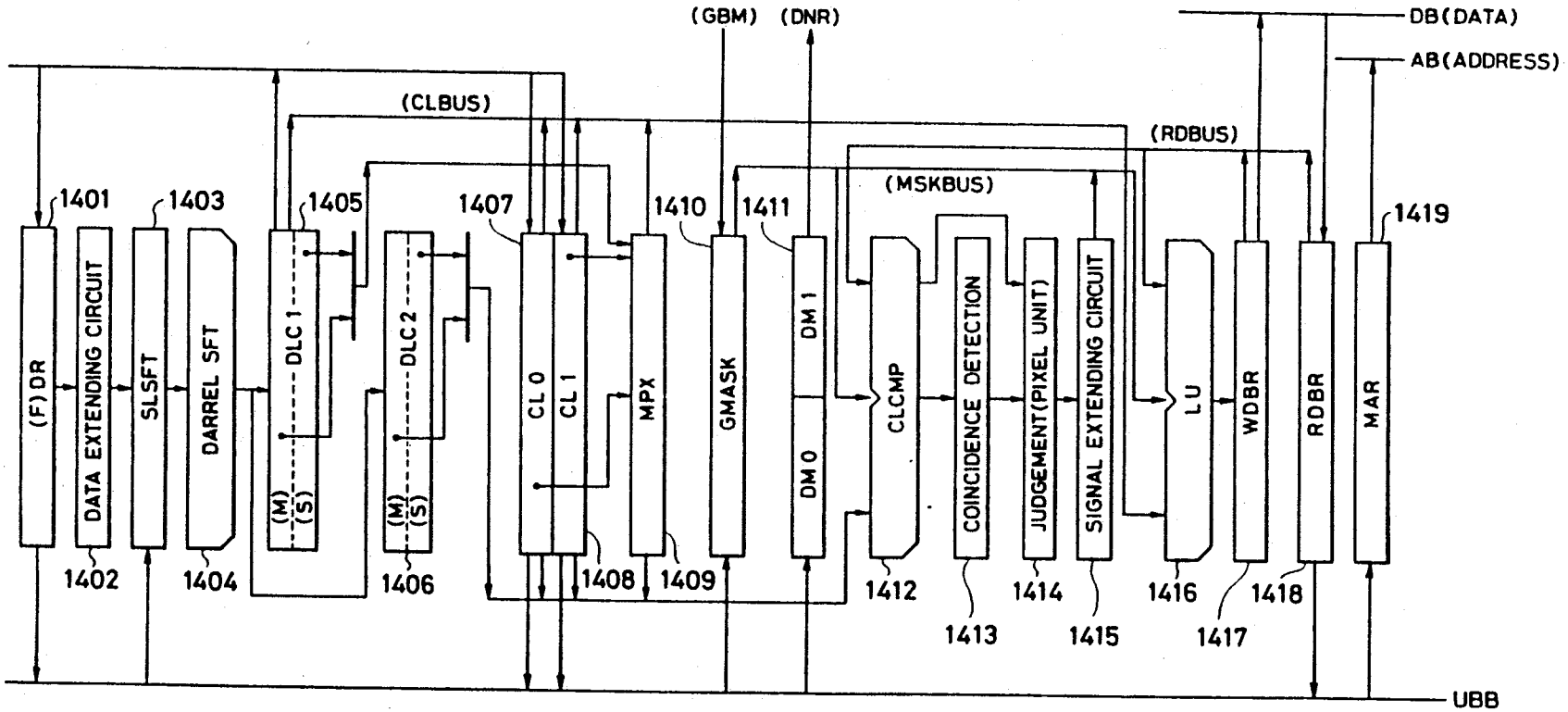
FIG. 6 is a block diagram showing the color data arithmetic unit of the graphic data processing system according to the embodiment.

FIGS. 1 and 6 are block diagrams showing the major portions of the graphic data processing system according to the present invention, respectively. In FIG. 1, the font data region of the image memory 12 is connected with an input of the color data arithmetic unit 140 and the output of this color data arithmetic unit 140 is connected with the display region of the image memory 12.

In FIG. 6, on the other hand, the color data arithmetic unit 140 is constructed of a font data register (FDR) 1401, a data extending circuit 1402, a source latch (SLSFT) 1403, a barrel shifter (BARREL SFT) 1404, a destination latch 1 (DLC1) 1405, a destination latch 2 (DLC1) 1406, a color register 0 (CL0) 1407, a color register 1 (CL1) 1408, a multiplexer (MPX) 1409, a graphic mask register (G MASK) 1410, a drawing mode register (DM) 1411, a color data comparator (CLCMP) 1412, a coincidence detecting circuit 1413, a condition judging circuit 1414, a signal extending circuit 1415, a logical arithmetic unit (LU) 1416, a write data buffer (WDBR) 1417, a read data buffer (RDBR) 1418, and a memory address register (MAR) 1419.

Figure 7:
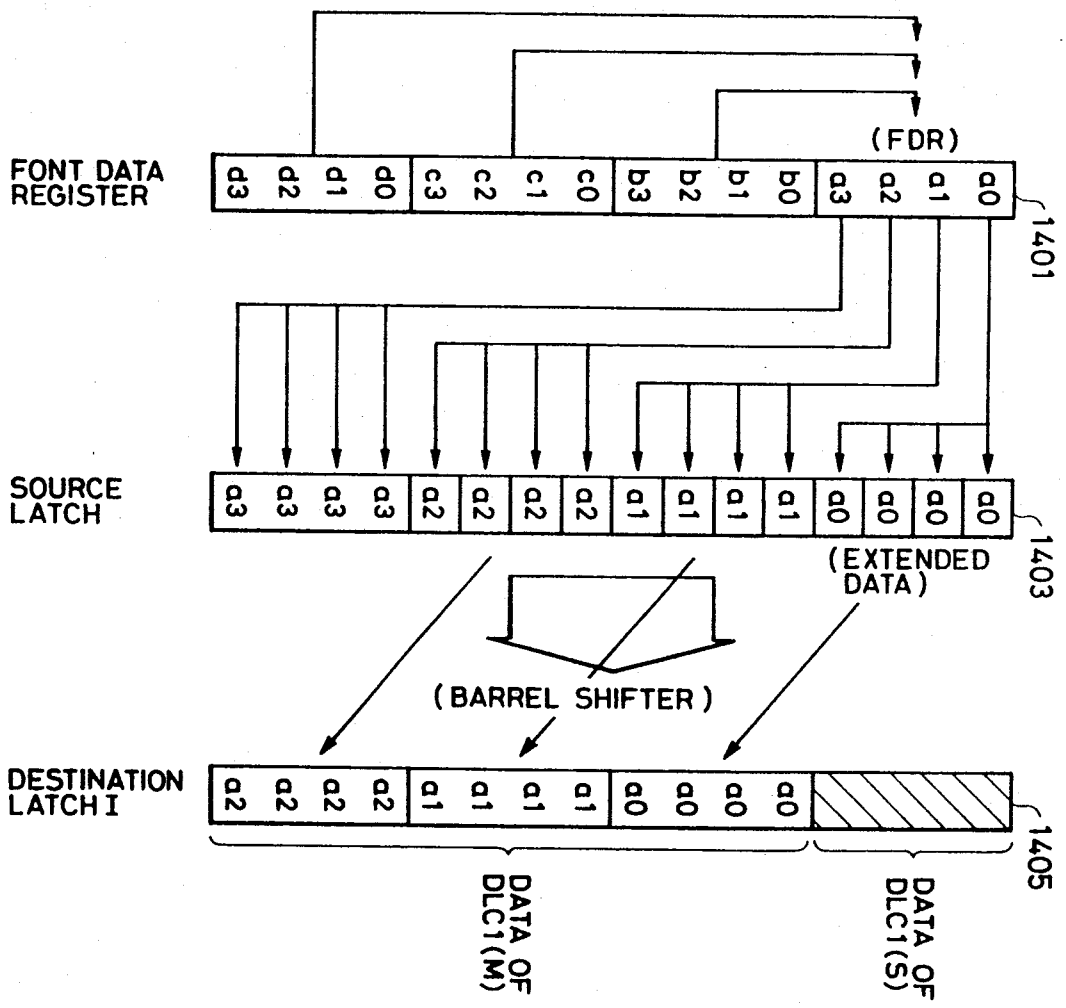
FIGS. 7 to 9 are individual diagrams for explaining the operations of the graphic data processing system according to the embodiment.
Figure 8:
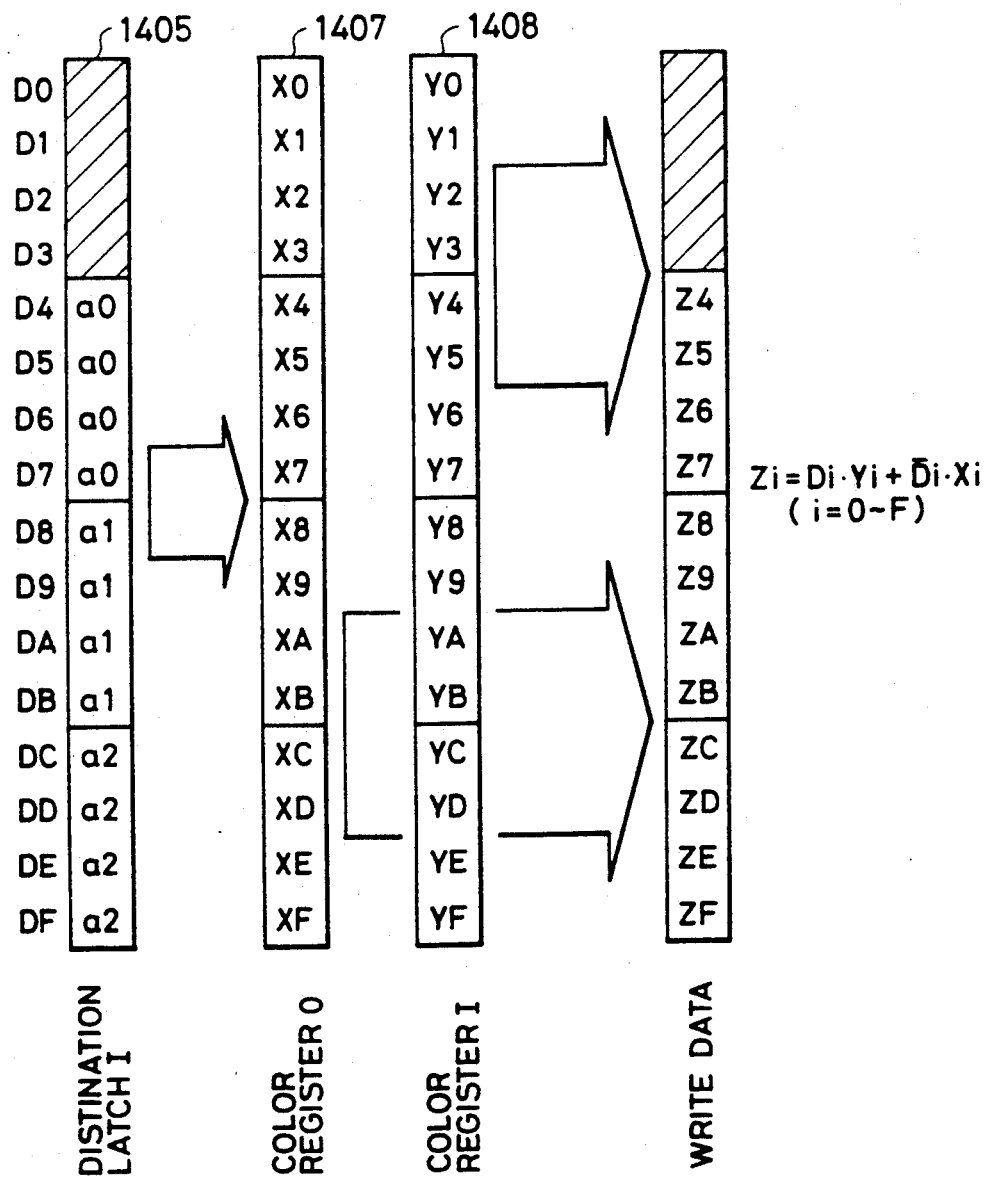

Next, the operations will be described with reference to FIGS. 7 to 9. First of all, as shown in FIG. 1, a character pattern is stored as ($k \times l$) ($k=5$ and $l=7$ in FIG. 1) monochromatic bit patterns, i.e., font data composed of "0" and "1" signals in the font data region. And, this font data are inputted from the font data region to the color data arithmetic unit 140.

The font data thus inputted are first read in the read data buffer (RDBR) 1418 of the color data arithmetic unit 140 and then latched in the font data register (FDR) 1401. Next, the font data thus latched are extended (simultaneously by one word) by the data extending circuit 1402 in response to the GBM signal indicating the bit number composing one pixel. For example, as shown in FIG. 7, each bit of the font data is extended into four bits (n=4), which are latched in the source latch (SL SFT) 1403. These extended data are shifted by the barrel shifter (BARREL SFT) 1404 to a bit position indicated by a written pixel address so that their bits may be arranged with those of the written data. This shifted result is temporarily stored in the (M) of the destination latch 1 (DLCl) 1405, and the (M) data are composed with the previous shift result (the (S) of the destination latch 1) to generate information corresponding to the write data.

Moreover, the font data are judged for each bit whether the signal is at "0" or "1". The values of color data 0 and 1 are selected for the "0" and "1" signals, respectively. Color data 0 and 1 are latched in the color registers 0 (CL0) 1407 and the color register 1 (CL1) 1408, respectively. Moreover, the data composed in the destination latch 1 (DLC1) 1405 are used as multiplex signals for selecting the color data 0 and 1 which are latched in those color register 0 (CL0) 1407 and color register 1 (CL1) 1408, respectively. As shown in FIG. 8, the multiplexer 1409 for selecting one bit is used for one word to select the color data 0 and 1, which are latched in the color register 0 (CL0) 1407 and the color register 1 (CL1) 1408, respectively, and the data of the destination latch (DLCl) 1405 independently for each bit, thus producing the write data.

These write data are sent to the logical arithmetic unit (LU) 1416 so that their logical arithmetic with the written data may be performed. This logical arithmetic unit (LU) 1416 is enabled to select the kind of the logical arithmetic operations in accordance with the mode designated by the drawing mode register (DM) 1411 and to designate a no-operation at each bit. In this no-operation case, the written data are outputted as they are. As a result, the case in which one word has bits left unwritten can be coped with by designating that bit with a no-operation signal. This no-operation signal is set in the graphic mask register (G MASK) 1410 by the control device 110 on the basis of the GBM signal and the information of the number of pixels to be processed. The output of the logical arithmetic unit (LU) 1416 are set in the write data buffer (WDBR) 1417 and written in the display region of the image memory 12.

On the other hand, the no-operation signal is connected with the output signal of a color condition comparator which is constructed of the color data comparator (CLCMP) 1412, the coincidence detecting circuit 1413, the condition judging circuit 1414 and the signal extending circuit 1415. The magnitudes of the write data and the written data are judged for one word at the unit of pixel. Each bit of the pixel having failed to match the condition designated by the drawing mode register (DM) 1411 is used as the no-operation signal. Thus, the drawing can be accomplished without deteriorating the background color of the character.

Figure 9:
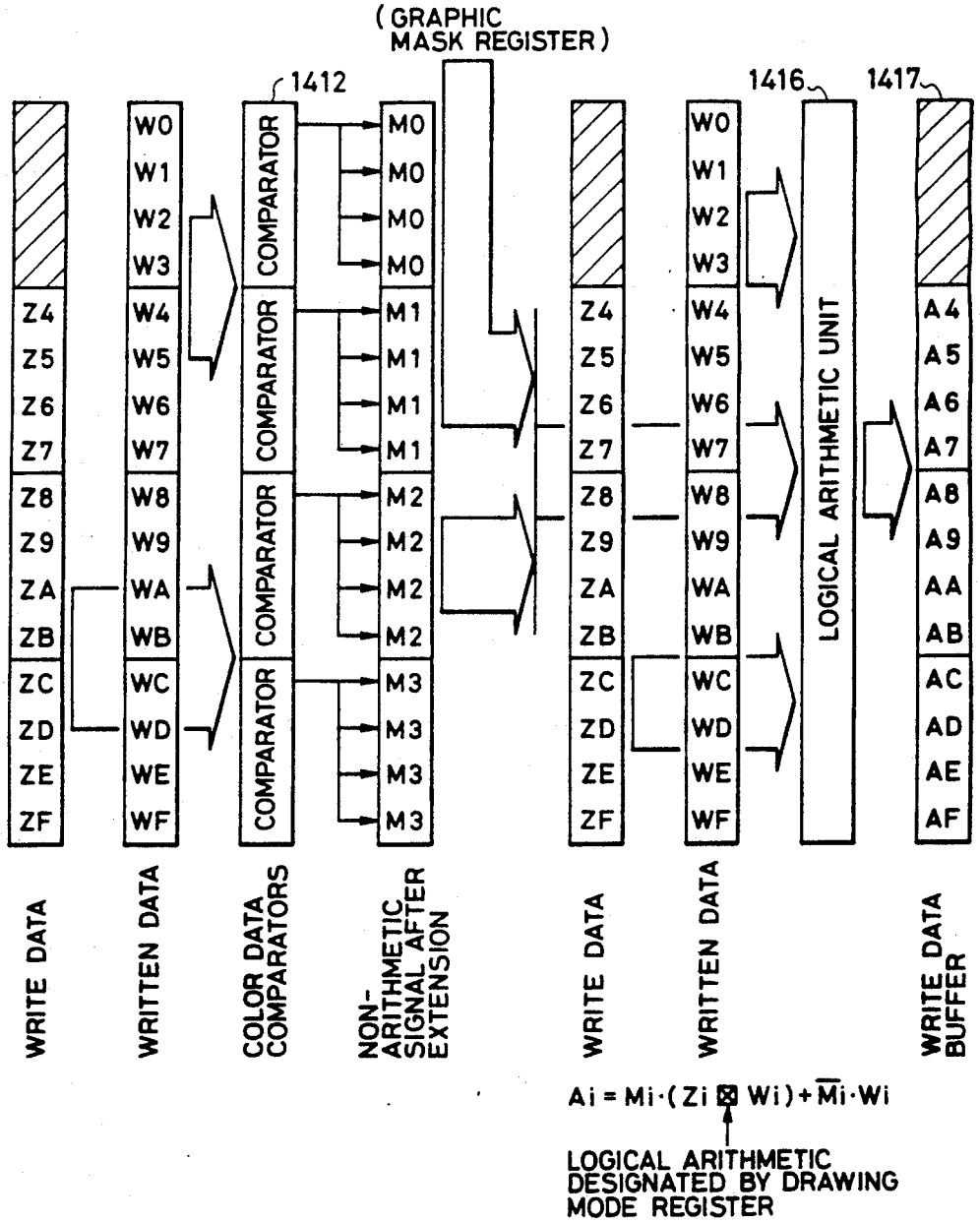

The relation between the color condition comparator and the logical arithmetic unit (LU) 1416 is such that the color data comparator (CLCMP) 1412 of the color condition comparator makes a judgement of the magnitudes at the unit of each pixel while deeming the bits in one pixel as a binary code, as shown in FIG. 9. The color data comparator (CLCMP) 1412 outputs the bits of the "1" signal, if the condition is satisfied, and otherwise the bits of the "0" signal. The logical arithmetic unit (LU) 1416 performs a logical arithmetic operation of only the portion of the "1" signal of that judged output bit and transfers the result to the write destination.

The data thus transferred to the display region of the image memory 12 are converted into a multi-bit value, e.g., four bits / pixel, as shown in FIG. 1, although the font data stored in the font data region of the image memory 12 are monochromatic.

Thus, according to the present embodiment, data of a plurality of pixels can be processed all at once by one reading, updating and writing process so that a drawing can be accomplished in a high memory accessing efficiency. Since, moreover, the font extension can be controlled in accordance with the bit length of one pixel, the structure can have a wide use.

According to the present invention, there can be attained an effect that the drawing process can be speeded up because the data of a plurality of pixels in one word can be changed by the single reading, updating and writing process.

We claim:

1. A graphic data processing system comprising:

an image memory having a font data region for storing a character pattern as font data composed of at least monochromatic information and a display region for storing graphic data of the character pattern, said image memory being a bit-map memory;

at least first and second color registers for holding color information corresponding respectively to "0" and "1" signals of the font data stored in the image memory;

data extending means for simultaneously extending, in response to a bit number indicator, m bits of the font data representing m pixels, which are stored in the image memory, into extended data having n ($n \geqq 2$) bits for each bit of font data where n bits represent one pixel;

a multiplexer for selecting color information for each of the n bits of the extended data, wherein said color information is latched in the first and second color registers, and wherein said selecting is performed by said multiplexer independently at respectively corresponding bit units on the basis of the extended data form the data extending means; and means for masking and writing the color information selected by the multiplexer, as graphic data at bit units in the image memory.

2. A graphic data processing system according to claim 1, wherein said font pattern is formed in ($k \times l$) monochromatic bit patterns.

3. A graphic data processing system according to claim 1, further comprising means for designating the bit number indicator at will.

4. A graphic data processing system according to claim 2, further comprising:

means for designating the bit number indicator at will so that the product of $n \times m$ may be constant; and an image output device for outputting image data written in said image memory.

5. A graphic data processing system comprising:

a processor including an image memory having a font data region for storing a character pattern as font data composed of at least monochromatic information and a display region for storing graphic data of the character pattern, said image memory being a bit-map memory, at least first and second color registers for holding color information corresponding respectively to "0" and "1" signals of the font data stored in the image memory, data extending means for simultaneously extending, in response to a bit number indicator, each bit of the font data, which are stored in the image memory, into extended data having n ($n \geqq 2$) bits for each bit of font data where n bits represent one pixel, a multiplexer for selecting color information for each of the n bits of the extended data, wherein said color information is latched int eh first and second color registers, and wherein said selecting is performed by said multiplexer independently at respectively corresponding bit units on the basis of the extended data from the data extending means, and means for making and writing the color information selected by the multiplexer, as graphic data at bit units in the image memory; and an image output device for outputting image data written in said image memory.

6. A graphic data processing system according to claim 5, wherein said font pattern is formed in ($k \times l$) binary bit patterns.

7. A graphic data processing system according to claim 5, further comprising means for designating the bit number indicator at will.

8. A graphic data processing system according to claim 5, wherein said image output device is a display device.

9. A graphic data processing system according to claim 5, wherein said image output device is a printer.

* * * * *